US006479813B2

(12) United States Patent
Takada et al.

(10) Patent No.: US 6,479,813 B2
(45) Date of Patent: Nov. 12, 2002

(54) STRUCTURE OF MOTOR-DRIVEN SWING UNIT

(75) Inventors: Noboru Takada, Yokohama (JP); Katsumi Yano, Yokohama (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 125 days.

(21) Appl. No.: 09/748,273

(22) Filed: Dec. 27, 2000

(65) Prior Publication Data

US 2001/0006218 A1 Jul. 5, 2001

(30) Foreign Application Priority Data

Dec. 27, 1999 (JP) ..... 11-369877

(51) Int. Cl.[7] ..... H01J 5/02
(52) U.S. Cl. ..... 250/239; 250/215; 396/427
(58) Field of Search ..... 250/239, 215; 396/427, 428, 419; 348/134, 151

(56) References Cited

U.S. PATENT DOCUMENTS 3,928,827 A * 12/1975 Kepka et al. ..... 250/239
5,760,390 A * 6/1998 Vezzalini et al. ..... 250/239
6,354,749 B1 * 3/2002 Pfaffenberger, II ..... 396/427

FOREIGN PATENT DOCUMENTS

JP 56-128542 * 10/1981 ..... 250/239
JP 9-284612 10/1997

* cited by examiner

*Primary Examiner*—Huy Mai
(74) *Attorney, Agent, or Firm*—McDermott, Will & Emery

(57) ABSTRACT

A motor-driven pan-tilt unit such as a pan-tilt camera mount designed to remotely control panning and tilting motion of, for example, a surveillance camera is provided. The pan-tilt unit includes a pan mechanism, a transmitting unit, and an optical signal transmitting unit. The pan mechanism has a stationary housing and a rotary shaft in connection with the camera. The transmitting unit includes a plurality of conductive rings and a plurality of conductive contacts. Each of the conductive rings is mounted on one of the rotary shaft and an inner wall of the stationary housing in electrical contact with one of the conductive contacts to establish transmission of electric power and control signals required for a tilt mechanism and the camera. The optical signal transmitting unit includes a light-emitting element and a light-sensitive element. One of the light-emitting element and the light-sensitive element is attached to an end of the rotary shaft so as to establish transmission of an optical signal from the light-emitting element to the light-sensitive element for transmitting image data from the camera to a signal processing circuit mounted on a stationary part of the pan-tilt unit. The housing defines therewithin a hermetic chamber within which the transmitting unit and the optical signal transmitting unit are disposed, thereby avoiding sticking of dust to the units, for example.

6 Claims, 4 Drawing Sheets

STRUCTURE OF MOTOR-DRIVEN SWING UNIT

BACKGROUND OF THE INVENTION

1. Technical Field of the Invention

The present invention relates generally to a motor-driven swing unit such as a pan-tilt camera mount designed to remotely control panning and tilting operations of pan and tilt mechanisms for orienting, for example, an image-capturing device such as a surveillance camera vertically and horizontally, and more particularly to an improved structure of a motor-driven swing unit capable of swinging a camera horizontally over a 360° range.

2. Background Art

Japanese Patent First Publication No. 9-284612 discloses an endlessely swingable motor-driven camera mount. FIG. 6 shows a conventional motor-driven camera mount of such a type. A camera 1 is mounted rotatably on a pan frame 3 through a tilt shaft 2. The tilt shaft 2 is connected to a tilt motor (not shown) through a gear train (not shown) and works to change a vertical angle of the camera 1 in a tilting operation.

The pan frame 3 is installed on a pan shaft 4. The pan shaft 4 is rotated by a pan motor (not shown) through a gear train (not shown) and works to change a horizontal angle of the camera 1 in a panning operation.

A bearing housing 5 has disposed therein bearings 6 which support the pan shaft 4 rotatably and is fixed on a fixture frame 7 which fixes the whole of the camera mount on the ceiling. A semitransparent dome cover 8 shields the camera 1, the tilt shaft 2, and the pan frame 3 for the purpose of presenting a fine appearance.

The camera mount also includes a slip ring transmitting unit. The slip ring transmitting unit consists of an insulating ring 9, conductive rings 10, and conductive contacts 11. The insulating ring 9 is installed on the periphery of an end portion of the pan shaft 4 projecting from the bearing 6. The conductive rings 10 are rotated by the pan shaft 4 through the insulating ring 9. The conductive contacts 11 are installed in a holder 12 secured on the bearing housing 5 through an insulating plate 13 in contact with the conductive rings 10. The slip ring transmitting unit works to establish transmission of power and control signals between a stationary assembly consisting of the bearing housing 5 and the fixture frame 7 and a swinging assembly consisting of the pan frame 3 and the pan shaft 4.

The camera mount also includes an optical signal transmitting unit which consists of a light-emitting element 14 and a light-sensitive element 15. The light-emitting element 14 is disposed within an end of a chamber of the pan shaft 4. The light-sensitive element 15 is mounted on the holder 12 and faces the light-emitting element 14. The optical signal transmitting unit converts an optical signal outputted from the light-emitting element 14 representing an image captured by the camera 1 to an electric signal. Specifically, the optical signal transmitting unit works to transmit an image signal from the swinging assembly to the stationary assembly.

The above motor-driven camera mount, however, has the following drawback. The motor-driven camera mount, as described above, has disposed therein the gear trains and stores therein grease for lubrication of the gear trains and elimination of mechanical noises, but oil contained in the grease is evaporated by a rise in inside temperature of the camera mount resulting from running of the pan and tilt motors, which results in formation of rarefied oil mist. The oil mist will stick to the surfaces of the inside parts of the camera mount to form oil films thereon. For example, they are formed on slidable electric contact surfaces of the slip ring transmitting unit and outer surfaces of the light-emitting element 14 and the light-sensitive element 15 of the optical signal transmitting unit The oil films usually absorb dust and lead to a failure of electric contacts between the conductive contacts 11 and the conductive rings 10 of the slip ring transmitting unit and cause the light sensitivity of the light-sensitive element 15 and the amount of light outputted from the light-emitting element 14 to be reduced, thus resulting in a decreased quality of the image signal.

Further, the slip ring transmitting unit is located above the bearing 5, so that the overall length of the camera mount will be greater than sum of an axial interval between the bearings 5 and a vertical length of the slip ring transmitting unit, thus resulting in an increased size of the camera mount.

SUMMARY OF THE INVENTION

It is therefore a principal object of the invention to avoid the disadvantages of the prior art.

It is another object of the invention to provide a motor-driven swing unit which has a small size, but is capable of keeping the reliability for a long time.

According to one aspect of the invention, there is provided a motor-driven swing unit which comprises: (a) a swing mechanism including a stationary housing and a rotary member disposed within the housing in connection with a device which requires motion control, the swing mechanism swinging the device through the rotary member; (b) a transmitting unit including a plurality of conductive rings and a plurality of conductive contacts, each of the conductive rings being mounted on one of the rotary member and the stationary housing of the swing mechanism in electrical contact with one of the conductive contacts to establish transmission of at least one of required electric power and a required signal therebetween; (c) an optical signal transmitting unit including a light-emitting element and a light-sensitive element separated physically from the light-emitting element, one of the light-emitting element and the light-sensitive element being attached to a portion of the rotary member in optical alignment of the light-emitting element and the light-sensitive element with an axis of rotation of the rotary member so as to establish transmission of an optical signal from the light-emitting element to the light-sensitive element for transmitting data to or from the device; and (d) a hermetic chamber defined within the housing of the swing mechanism, the hermetic chamber having disposed therein the transmitting unit and the optical signal transmitting unit.

In the preferred mode of the invention, a signal processing circuit is further provided which processes an output of the light-sensitive element produced by the optical signal from the light-emitting element. The signal processing circuit includes an AGC amplifier controlling a gain of the output of the light-sensitive element.

The signal processing circuit may also include a frequency compensation circuit for compensating for a frequency of the output of the light-sensitive element.

The hermetic chamber may be filled with inert gas.

The swing mechanism also includes two bearings disposed within the housing at a given interval away from each other in alignment with the axis of rotation of the rotary member for supporting the rotary member rotatably. The hermetic chamber is made up of a first and a second closed chamber. The first closed chamber is formed by a first inner wall of the housing between the two bearings. The second closed chamber is formed by a second inner wall of the housing outside the bearings.

The swing mechanism also includes a cover installed on an open end of the housing to define the second chamber between an inner wall of the cover and a surface of one of the bearings.

BRIEF DESCRIPTION OF THE DRAWINGS

The present invention will be understood more fully from the detailed description given hereinbelow and from the accompanying drawings of the preferred embodiments of the invention, which, however, should not be taken to limit the invention to the specific embodiments but are for the purpose of explanation and understanding only.

In the drawings.

DESCRIPTION OF THE PREFERRED EMBODIMENTS

Figure 1:
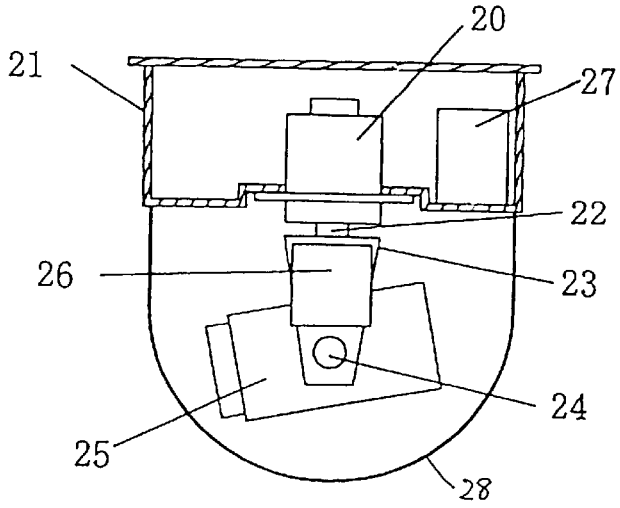
FIG. 1 is a partially vertical sectional view which shows a motor-driven swing unit according to the first embodiment of the invention which is used with a camera mount as an example.

Referring to the drawings, wherein like reference numbers refer to like parts in several views, particularly to FIG. 1, there is shown a motor-driven swing unit according to the invention. The discussion below will refer to an electrically controlled pan-tilt mount for cameras, but the invention may be used with a swing control unit for any other devices requiring swing motion control.

The motor-driven swing unit includes a signal transmitting unit 20, a fixture frame 21, a pan mechanism, and a tilt mechanism, a swing circuit board 26, a stationary circuit board 27, and a dome cover 28.

The signal transmitting unit 20 is installed in the fixture frame 21 and includes the part of the pan mechanism as will be apparent from discussion below. The pan mechanism includes a hollow pan shaft 22 and a pan frame 23. The fixture frame 21 is secured on the ceiling of a room, for example. The pan shaft 22 is supported to be rotatable relative to the signal transmitting unit 20. The pan frame 23 is retained by the pan shaft 22 and holds a camera 25 such as a surveillance camera through the tilt shaft 24. The pan shaft 22 is coupled to and driven by a pan motor (not shown) through a pan gear train (not shown) to swing the pan frame 23 horizontally, thereby changing a horizontal angle of the camera 25 in a panning operation.

The tilt mechanism includes a tilt shaft 24 which is coupled to a tilt motor (not shown) and a tilt gear train (not shown) and works to rotate vertically to change a vertical angle of the camera 25 in a tilting operation. The pan motor, the tilt motor, the pan gear train, and the tilt gear train may have known structures, which are not an essential part of the invention, and explanation thereof in detail will be omitted here The swing circuit board 26 has mounted thereon a tilt motor drive circuit, a control signal interface circuit, an image signal receiving circuit, and a power supply circuit. The control signal interface circuit establishes transmission of control signals between itself and the swing circuit board 26. The image signal receiving circuit receives an image signal representing an image captured by the camera 25.

The dome cover 28 is made of a semitransparent plastic material and covers the camera 25 and the tilt and pan mechanisms for representing a fine appearance of the swing unit and shields orientation of the camera 25 visually.

Figure 2:
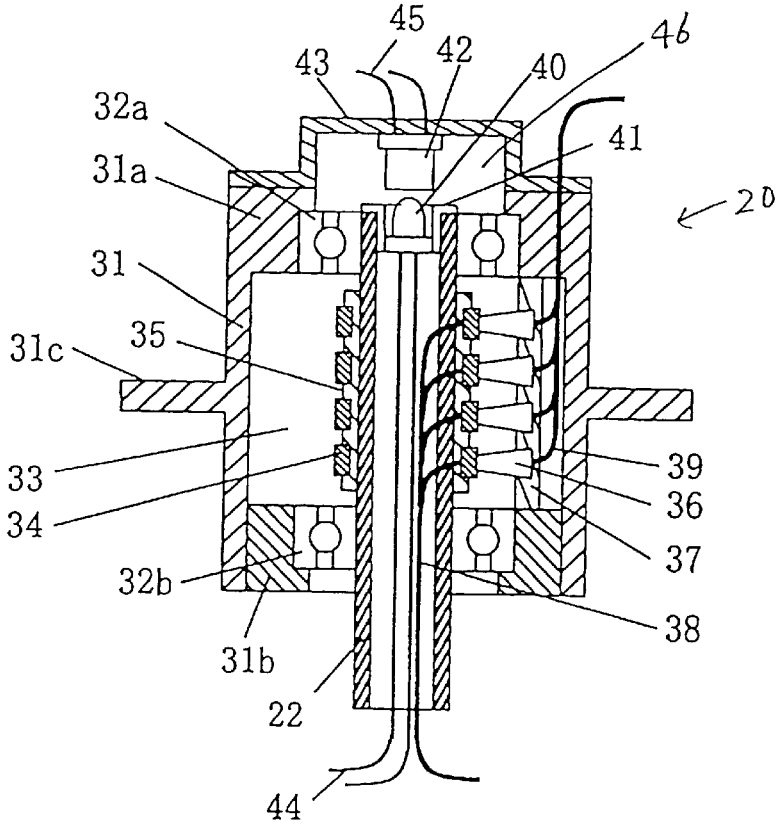
FIG. 2 is a vertical sectional view which shows an internal structure of a signal transmitting unit installed in the swing unit of FIG. 1.

The signal transmitting unit 20, as clearly shown in FIG. 2, includes a stationary bearing housing 31 as the part of the pan mechanism. The bearing housing 31 has dispose d therein ball bearings 32*a* and 32*b* which retain the pan shaft 22 rotatably for panning the camera 25 and has a flange 31*c* which is, as can be seen in FIG. 1, secured on the fixture frame 21.

The bearing housing 31, the bearings 32*a* and 32*b*, and the pan shaft 22 define a first closed chamber 33 isolated from the outside of the bearing housing 31.

Within the first chamber 33, a slip ring transmitting unit is disposed which includes a plurality of conductive rings 34, a plurality of conductive contacts 36, an insulating ring 35, and an insulating plate 37. The conductive rings 34 are arranged vertically and mounted on the periphery of the pan shaft 22 between the bearings 32*a* and 32*b* through the insulating ring 35. The conductive contacts 36 are secured on an inner wall of the bearing housing 31 through the insulating plate 37 so that they are in constant electric contact with the conductive rings 34, respectively. The conductive contacts 36 are pressed by the insulating plate 37 against the conductive rings 34 elastically to establish constant engagement therewith. The conductive contacts 36 may alternatively be urged elastically using any other additional member.

The conductive rings 34 may alternatively be installed on the inner wall of the bearing housing 31, while the conductive contacts may be mounted on the pan shaft 22.

Leads 38 are disposed within the pan shaft 22 to establish electric connections between the conductive rings 34 and the swing circuit board 26. Additionally, leads 39 extend through a hole formed in the bearing housing 31 to establish electric contacts between the conductive contacts 36 and the stationary circuit board 27.

The signal transmitting unit 20 also includes a cover 43 which is mounted on an end of the bearing housing 31 to define a second closed chamber 46 together with the bearing 32*a*, an end of the pan shaft 22, a holder 41, and a light-emitting element 40. The second chamber 46 is isolated from the outside of the bearing housing 31.

Within the second chamber 46, an optical signal transmitting unit is installed which includes the light-emitting element 40, a light-sensitive element 42, and the holder 41. The light-emitting element 40 is retained by the holder 41 within an end of the pan shaft 22 in alignment of an optical axis thereof with the longitudinal center line (i.e., an axis of rotation) of the pan shaft 22. The light-sensitive element 42 is installed on an inner wall of the cover 43 in alignment with the light-emitting element 40 and converts light outputted from the light-emitting element 40 into an electrical signal.

Leads 44 extend from the inside of the pan shaft 22 to the swing circuit board 26 to establish electrical connections between the light-emitting element 40 and an image signal generating circuit mounted on the pans circuit board 26. The image signal generating circuit provides an image signal representing an image captured by the camera 25 to the light-emitting element 40. The light-emitting element 40 is responsive to the image signal to output an optical signal to the light-sensitive element 42. The light-sensitive element 42 converts the inputted optical signal into an electrical image signal and outputs it to an image signal receiving circuit mounted on the stationary circuit board 27 through leads 45.

The power required to actuate the camera 25, the tilt motor, and each circuit element for the tilt mechanism mounted on the swing circuit board 26 is supplied from the power supply circuit mounted on the stationary circuit board 27 through the leads 39, the conductive contacts 36, the conductive rings 34, and the leads 38. The electrical communication between each of the conductive contacts 36 and one of the conductive rings 34 is, as described above, kept elastically, thus assuring stable transmission of the power and control signals from the stationary part to the movable port of the swing unit even during rotation of the pan shaft 22.

The slip ring transmitting unit and the optical signal transmitting unit are, as described above, disposed within the first and second hermetic chambers 33 and 46, thereby avoiding intrusion of oil mist or dust into the slip ring transmitting unit and the optical signal transmitting unit, which will keep free from oil and dust to the light-emitting element 40, the light-sensitive element 42, and the sliding parts of the slip ring transmitting unit, thus ensuring steady transmission of the signals. This also facilitates ease of handling of the slip ring transmitting unit and the optical signal transmitting unit in deassembling processes for the maintenance of the swing unit, thereby minimizing the possibility of breakage of and sticking of dirt to the slip ring transmitting unit and the optical signal transmitting unit.

Figure 6:
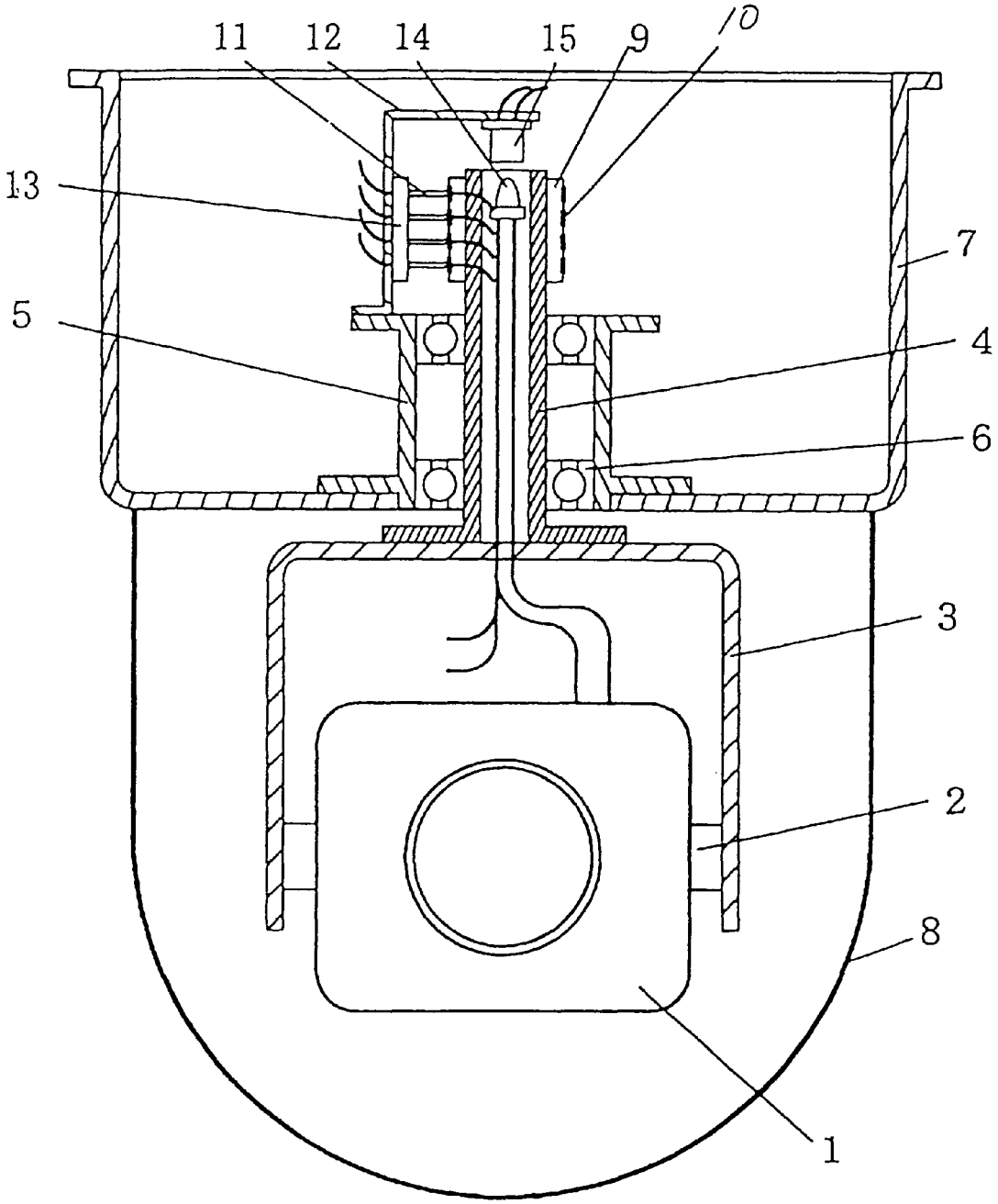
FIG. 6 PRIOR ART
FIG. 6 is a vertical sectional view which shows a conventional motor-driven camera mount.

Between the bearings 32*a* and 32*b*, the slip ring transmitting unit is disposed, thereby allowing the total length of the swing unit to be reduced as compared with the conventional structure shown in FIG. 6.

Figure 3:
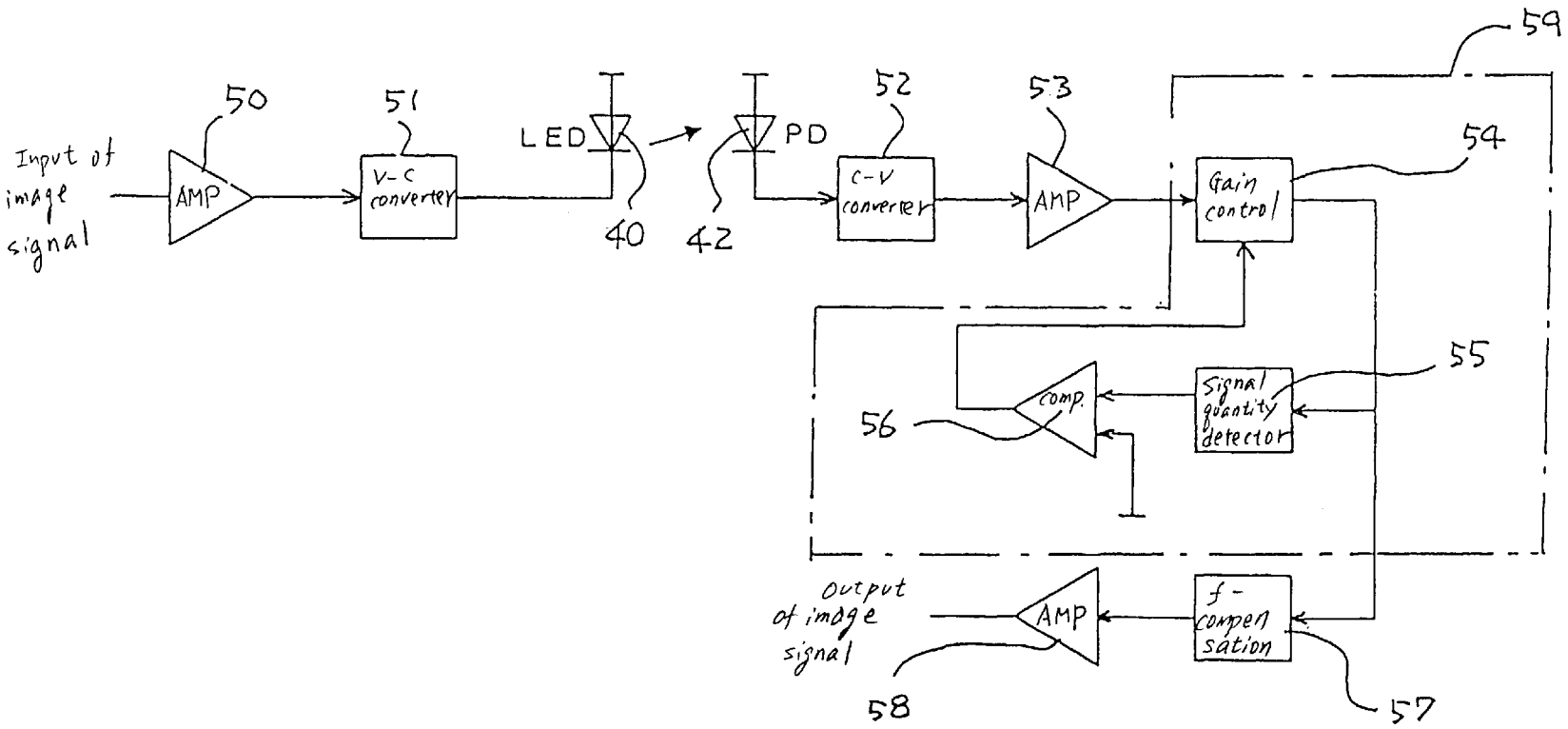
FIG. 3 is a circuit diagram which shows an image signal generating circuit and an image signal receiving circuit.

FIG. 3 shows circuit structures of the image signal generating circuit and the image signal receiving circuit mounted on the swing circuit board 26 and the stationary circuit board 27, respectively.

The image signal generating circuit includes a buffer amplifier 50 and a voltage-current converting circuit 51. The buffer amplifier 50 amplifies an input from the camera 25 and outputs a voltage signal. The voltage-current converting circuit 51 converts the inputted voltage signal into a current signal and outputs it to the light-emitting element 40 made of an LED, for example.

The image signal receiving circuit is connected to the light-sensitive element 42 made of a photo-diode (PD), for example, and includes a current-voltage converting circuit 52, a buffer amplifier 53, an f-characteristic compensating circuit 57, a buffer amplifier 58, and an AGC amplifier 59. The current-voltage converting circuit 52 converts a current signal produced by the light-sensitive element 42 into a voltage signal and outputs it to the buffer amplifier 53. The buffer amplifier 53 amplifies the input and outputs it to the AGC amplifier 59. The AGC amplifier 59 consists of a gain control amplifier 54, a signal quantity detecting circuit 55, and a comparator 56. The gain control amplifier 59 is responsive to a gain control signal to control the gain. The signal quantity detecting circuit 55 produces an SYNC level signal as a function of the level of an SYNC signal. The comparator 56 compares the SYNC level signal outputted from the signal quantity detecting circuit 55 with a reference level and provides the gain control signal to the gain control amplifier 54. The f-characteristic compensating circuit 57 compensates for a high frequency component of the output from the gain control amplifier 54 and outputs it to the buffer amplifier 58. The buffer amplifier 58 amplifies the input from the f-characteristic compensating circuit 57 to produce the image signal.

Operations of the image signal generating circuit and the image signal receiving circuit will be discussed in more detail below.

A signal of an image captured by the camera 25 is first inputted to the buffer amplifier 50. The buffer amplifier 50 amplifier 53 based on the gain control signal so that the SYNC level signal may be kept at a desired constant level, thereby keeping the level of the image signal constant.

The image signal outputted from the gain control amplifier 54 is inputted to the f-characteristic compensating circuit 57. The f-characteristic compensating circuit 57 compensates for a reduction in high frequency of the image signal caused by a change in frequency characteristic resulting from the current-to-light conversion of the light-emitting element 40 and a change in frequency characteristic resulting from the light-to-current conversion of the light-sensitive element 42.

The AGC amplifier 59, as described above, keeps the level of the SYNC signal constant, thereby keeping the level of the image signal constant regardless of an undesirable change in efficiency of signal transmission in the slip ring transmitting unit and the optical signal transmitting unit caused by the deterioration of the light-emitting element 40 and the light-sensitive element 42 resulting from the use for a long time, a change in ambient temperature, or dirt, thus assuring a high quality of images.

Additionally, the use of the f-characteristic compensating circuit 57 enables compensation for the deterioration in the image signal caused by the frequency dependent characteristics of the light-emitting element 40 and the light-sensitive element 42, thus assuring a high quality of images.

The bearing housing 31 consists of two parts: a hollow cylindrical member 31*a* and a disc member 31*b*, but may amplifies the input and also subjects it to an impedance-conversion. The current-voltage converting circuit 51 converts the voltage of the input from the buffer amplifier 50 into a current signal required to actuate the light-emitting element 40 optically. The light-emitting element 40 is responsive to the current signal from the voltage-current converting circuit 51 to output an optical signal to the light-sensitive element 42 through the leads 44.

The light-sensitive element 42 converts the optical signal from the light-emitting element 40 into a current signal and transmits it to the current-voltage converting circuit 52 through the leads 45. The current-voltage converting circuit 52 converts the input into a voltage signal and outputs it to the gain control amplifier 54.

The gain control amplifier 54 amplifies the image signal inputted thereinto and outputs it the signal quantity detecting circuit 55. The signal quantity detecting circuit 55 extracts an SYNC signal from the image signal and produces an SYNC level signal as a function of the level of the SYNC signal. The comparator 56 compares the SYNC signal from the signal quantity detecting circuit 55 with the reference level and produces a gain control signal which works to decrease the gain of the output from the buffer amplifier 53 when the SYNC level signal is greater than the reference level or increase it when the SYNC level signal is smaller than the reference level. The gain control signal is inputted to a gain control signal input terminal of the gain control amplifier 54. The gain control amplifier 54 adjusts the gain of the output from the buffer alternatively be made of a one-piece member or more than two separate parts.

The ball bearings 32*a* and 32*b* may be replaced with any other type of bearings such as slide bearings using an oil retaining metal.

Either or both of the first and second hermetic chambers 33 and 46 may be filled with inert gas.

Figure 4:
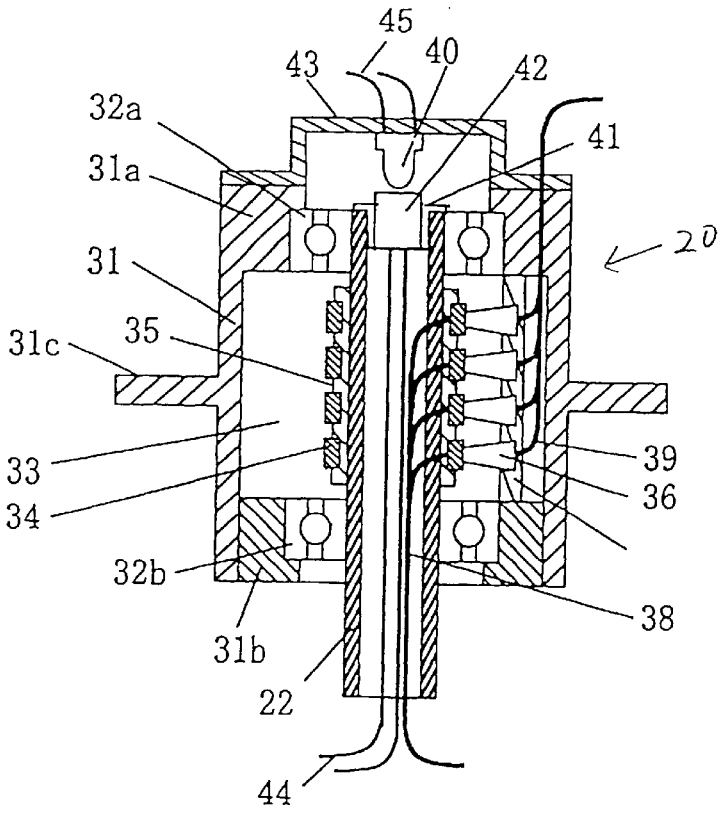
FIG. 4 is a vertical sectional view which shows an internal structure of a signal transmitting unit installed in a motor-driven swing unit according to the second embodiment of the invention.
Figure 5:
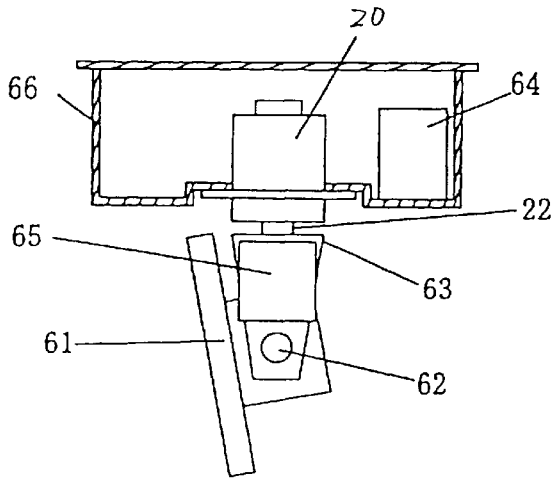
FIG. 5 is a partially vertical sectional view which shows a display unit with which the signal transmitting unit of FIG. 4 is used.

FIGS. 4 and 5 show a motor-driven swing unit according to the second embodiment of the invention which is different from the one shown in FIG. 2 only in that the light-emitting element 40 of the signal transmitting unit 20 is installed on the inner wall of the cover 43, and the light-sensitive element 42 is retained in the holder 41 fitted within the pan shaft 22. Other arrangements are identical, and explanation thereof in detail will be omitted here.

FIG. 5 shows an example in which the swing unit of the second embodiment is used with a display unit which visually presents image information to people within a room.

The signal transmitting unit 20 is mounted in a fixture frame 66. The pan shaft 22 retains a pan frame 63. The pan frame 63 holds a display 61 through a tilt shaft 62. The pan shaft 22 is, like the first embodiment, rotated by a pan motor through a gear train to swing the pan frame 63 horizontally, thereby panning the display 61.

The tilt shaft 62 is, like the first embodiment, rotated by a tilt motor through a gear train to tilt the display 61 vertically.

Unlike the first embodiment, an image signal generating circuit is mounted on a stationary circuit board 64. An image signal receiving circuit is mounted on a swing circuit board 65.

In operation, the image signal generating circuit produces an image signal to be indicated on the display 61 visually and outputs it to the light-emitting element 40. The light-emitting element 40 outputs the image signal optically to the light-sensitive element 42. The light-sensitive element 42 transmits the image signal to the image signal receiving circuit mounted on the swing circuit board 65. The signal receiving circuit outputs the image signal to the display 61.

The power required to actuate the display 61, the tilt motor, and each circuit element for the tilt mechanism mounted on the swing circuit board 63 and control data for controlling the tilt motor and setting operational conditions of the display 61 are supplied from the stationary circuit board 64 to the swing circuit board 65 through the slip ring transmitting unit. Specifically, the transmission of the power and the control data from a stationary portion to a movable portion of the swing unit through the slip ring transmitting unit enables horizontal endless rotation of the display 61.

While the present invention has been disclosed in terms of the preferred embodiments in order to facilitate better understanding thereof, it should be appreciated that the invention can be embodied in various ways without departing from the principle of the invention. Therefore, the invention should be understood to include all possible embodiments and modifications to the shown embodiments witch can be embodied without departing from the principle of the invention as set forth in the appended claims. For example, the transmission of the control data through the slip ring transmitting unit may be achieved using the so-called handshake method in which a receiver produces a confirmation signal in response to received data and outputs it to a transmitter, thereby avoiding transmission of erroneous control data resulting from a failure in electrical contact in the slip ring transmitting unit caused by the oxidization of and sticking of dust to the parts of the slip ring transmitting unit. Additionally, a coding circuit and a decoding circuit may be provided in the transmitter and the receiver, respectively. The transmitter may subject the control data to error-correction and outputs it to the receiver, thereby minimizing an error rate of the control data to improve the reliability of the data transmission.

What is claimed is:

1. A motor-driven swing unit comprising:

a swing mechanism including a stationary housing and a rotary member disposed within the housing in connection with a device which requires motion control, said swing mechanism swinging the device through the rotary member;

a transmitting unit including a plurality of conductive rings and a plurality of conductive contacts, each of the conductive rings being mounted on one of the rotary member and the stationary housing of said swing mechanism in electrical contact with one of the conductive contacts to establish transmission of at least one of required electric power and a required signal therebetween;

an optical signal transmitting unit including a light-emitting element and a light-sensitive element separated physically from the light-emitting element, one of the light-emitting element and the light-sensitive element being attached to a portion of the rotary member in optical alignment of the light-emitting element and the light-sensitive element with an axis of rotation of the rotary member so as to establish transmission of an optical signal from the light-emitting element to the light-sensitive element for transmitting data to or from the device; and a hermetic chamber defined within the housing of said swing mechanism, said hermetic chamber having disposed therein said transmitting unit and said optical signal transmitting unit.

2. A motor-driven swing unit as set forth in claim 1, further comprising a signal processing circuit processing an output of the light-sensitive element produced by the optical signal from the light-emitting element, said signal processing circuit including an AGC amplifier controlling a gain of the output of the light-sensitive element.

3. A motor-driven swing unit as set forth in claim 1, further comprising a signal processing circuit processing an output of the light-sensitive element produced by the optical signal from the light-emitting element, said signal processing circuit including a frequency compensation circuit for compensating for a frequency of the output of the light-sensitive element.

4. A motor-driven swing unit as set forth in claim 1, wherein said hermetic chamber is filled with inert gas.

5. A motor-driven swing unit as set forth in claim 1, wherein said swing mechanism also includes two bearings disposed within the housing at a given interval away from each other in alignment with the axis of rotation of the rotary member for supporting the rotary member rotatably, and wherein said hermetic chamber is made up of a first and a second closed chamber, the first closed chamber being formed by a first inner wall of the housing between the two bearings, the second closed chamber being formed by a second inner wall of the housing outside the bearings.

6. A motor-driven swing unit as set forth in claim 5, wherein said swing mechanism also includes a cover installed on an open end of the housing to define the second chamber between an inner wall of the cover and a surface of one of the bearings.

* * * * *